United States Patent [19]

Ahr et al.

[11] 4,441,212

[45] Apr. 10, 1984

[54] BIB

[75] Inventors: Nicholas A. Ahr; David M. Moret, both of Cincinnati, Ohio

[73] Assignee: The Procter & Gamble Company, Cincinnati, Ohio

[21] Appl. No.: 431,897

[22] Filed: Sep. 30, 1982

[51] Int. Cl.[3] ..... A41B 13/10; A41D 13/04

[52] U.S. Cl. ..... 2/49 R

[58] Field of Search ..... 2/49 R, 49 A, 48, 52, 2/50, 51

[56] References Cited

U.S. PATENT DOCUMENTS

| | | | |
|---|---|---|---|
| 2,164,369 | 7/1939 | Woolever | 2/49 R |
| 2,469,835 | 5/1949 | McMartin | 2/49 R |
| 3,010,111 | 11/1961 | Ralph | 2/49 |
| 3,146,464 | 9/1964 | Burnett | 2/49 R |
| 3,328,807 | 6/1967 | Strauss | 2/49 |
| 3,416,157 | 12/1968 | Marder et al. | 2/49 |
| 3,995,321 | 12/1976 | Johnson | 2/49 R |
| 4,233,688 | 11/1980 | Hjerl | 2/49 R |
| 4,261,057 | 4/1931 | Anderson | 2/49 R |

*Primary Examiner*—Doris L. Troutman

*Attorney, Agent, or Firm*—Thomas J. Slone; Fredrick H. Braun; Richard C. Witte

[57] ABSTRACT

A bib, preferably disposable, having a top panel, a full-width pocket, and an apron panel depending below the pocket. Preferably, the apron panel pendulously depends from the upper edge of the front wall of the pocket so that the weight of the apron panel acts to gravitationally open the pocket and hold it open, and so that the apron panel may be used as a face wipe without inverting the pocket. Additionally, the top panel may be provided with transverse cuts adjacent the upper corners of the pocket and/or the end seams of the pocket may be gusseted or pleated to further promote gravitational opening of the pocket. The bib may further comprise: bendable, form-sustaining stays to enable the pocket to be manually opened and closed; a line-of-weakening to enable detaching all or a part of the apron panel for use as a post-use wipe; and a detachable neck opening portion.

9 Claims, 7 Drawing Figures

BIB

DESCRIPTION

1. Technical Field

This invention pertains to providing bibs for use on, for example, babies being fed. More particularly, it pertains to providing such bibs with full-width pockets, and apron panels which depend below the pockets. As used herein, a full-width pocket is a pocket which, at least at its top, extends substantially the full-width of the bib: i.e., the end-seams of the pocket are sufficiently coextensive with the side edges of the body of the bib that the top corners of the pocket are disposed on the side edges of the body of the bib or adjacent thereto.

2. Background Art

Background art patents disclose bibs having full-width pockets, and form-sustaining means for opening the pockets and keeping them open during use: for example, U.S. Pat. No. 3,010,111 which issued Nov. 28, 1961 to H. J. Ralph. Bibs having full-width pockets are also shown in the following U.S. Pat. Nos.: 3,146,464 which issued Sept. 1, 1964 to E. N. Burnett; 3,328,807 which issued July 4, 1967 to K. Strauss; 3,416,157 which issued Dec. 17, 1968 to H. L. Marder et al; and 3,995,321 which issued Dec. 7, 1976 to Sally Johnson. Additionally, bibs having removable neck-opening panels are disclosed in U.S. Pat. Nos. 3,146,464 (above), and 4,233,688 which issued Nov. 18, 1980 to Joana Hjerl. Also, U.S. Pat. No. 4,261,057 which issued Apr. 14, 1981 to Karl G. B. Anderson discloses a bib construction comprising a full-width pocket which pocket has pleated end seams.

Disclosure of the Invention

In accordance with one aspect of the invention, a bib is provided which comprises a top panel, a full-width pocket, an apron panel which depends below the pocket, and attachment means. In a preferred embodiment, the apron panel pendulously depends from the upper edge of the front wall of the pocket. Additionally, the top panel may be provided with traverse cuts adjacent the upper corners of the pocket and/or the end seams of the pocket may be gusseted or pleated to promote gravitational opening of the pocket. Furthermore the bib may be provided with form-sustaining means such as bendable, form-sustaining stays for enabling manually opening and closing the pocket; a removable neck-opening panel; and a detachable apron panel or portion thereof. Preferably, such a bib is made to be disposable by fabricating it from a relatively inexpensive laminate comprising a liquid impervious backsheet; and an absorbent topsheet. Alteratively, it may, for example, be made from a plastic coated paper or plastic film coated with absorbent material such as papermaking or other absorbent fibers. Also, preferably, the bib comprises one or more tape-type fasteners or other closure or attachment means including but not limited to refastenable means.

BRIEF DESCRIPTION OF THE DRAWINGS

While the specification concludes with claims which particularly point out and distinctly claim the subject matter regarded as forming the present invention, it is believed the invention will be better understood from the following description taken in conjunction with the accompanying drawings in which:

DETAILED DESCRIPTION OF THE INVENTION

Figure 1:
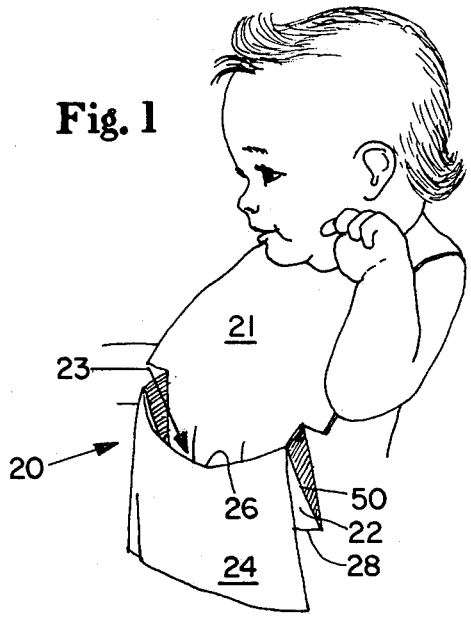
FIG. 1 is an in-use perspective view of a disposable bib which is an exemplary disposable bib embodiment of the present invention.

An exemplary bib which is a disposable embodiment of the present invention is designated 20 in FIG. 1. Bib 20 comprises top panel 21, pocket panel 22, a full-width pocket 23, and apron panel 24. As shown in FIG. 1, it has been fastened about the neck of a baby by fastening means which are not visible in FIG. 1, but which may be a tape-type fastener 25, FIG. 2. The apron panel 24, FIG. 1, pendulously depends from the upper edge 26 of pocket panel 22; and the top panel 21 is shown to have been cut by a short transverse cut 27, FIG. 2, adjacent each top corner of pocket 23 to promote gravitational opening of pocket 23.

Briefly, bib 20 is preferably made to be disposable by virtue of being made from a unitary blank of a relatively inexpensive laminate comprising a plastic film backsheet (i.e., polyethylene), and an absorbent paper topsheet albeit it is not intended to thereby limit the present invention.

Figure 2:
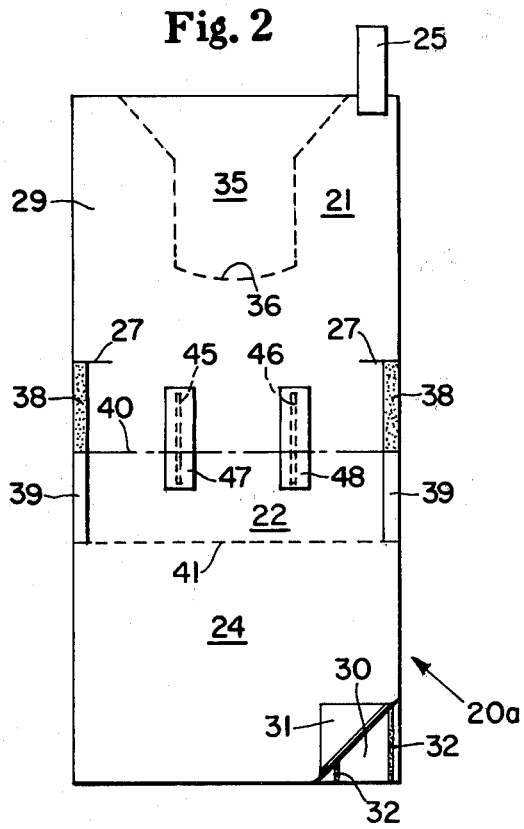
FIG. 2 is a plan view of a partially converted, flat blank from which the disposable bib in FIG. 1 may be made.

FIG. 2 is a plan view of a partially completed bib which is designated 20*a*, and which comprises a unitary blank 29, a tape-type fastener 25, and form-sustaining stays 45 and 46 which are secured to blank 29 by adhesive tapes 47 and 48, respectively.

Unitary blank 29, FIG. 2, is a 2-ply laminate which comprises a liquid impervious backsheet 30 and an absorbent topsheet 31. Preferably, backsheet 30 is a thermoplastic film: for instance polyethylene having a thickness of from about one-half-mil (about 0.0127 mm) to about one-and-one-half mils (about 0.0381 mm). Also, preferably, the topsheet 31 comprises wet strength tissue paper having a basis weight of from about ten to about fifty pounds per three-thousand square feet (about 16.3 to about 81.5 grams per square meter). As shown by the peeled-back portion of topsheet 31 in FIG. 2, it is secured to backsheet 30 with a plurality of glue bead lines 32.

Still referring to FIG. 2, blank 29 has a removable neck opening panel 35 defined by a line-of-perforations 36, two relatively short transverse cuts 27, two seam areas 38, two seam areas 39, and two transverse fold lines 40 and 41 which define pocket panel 22 therebetween. The portion of blank 29 disposed above fold line 40 is the top panel 21; and the portion of blank 29 disposed below fold line 41 is apron panel 24. Fold line 41 may in fact be a line-of-weakening to facilitate tear-off removal of the apron panel 24 for post-bib-use wipe up. Also, panel 35 may be used as a wipe after removing it by tearing along line-of-perforations 36.

Figure 3:
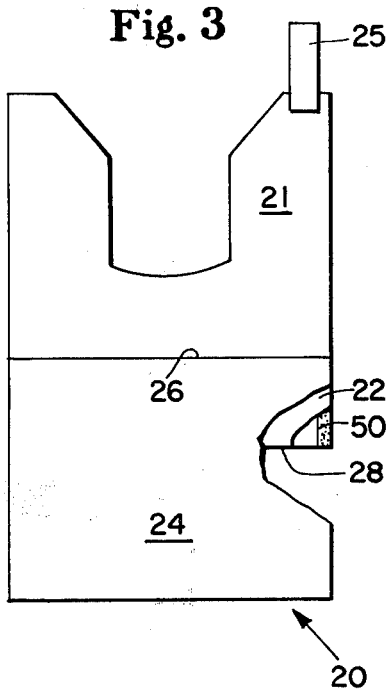
FIG. 3 is a plan view of the disposable bib of FIG. 1: i.e., of the partially converted blank of FIG. 2 after it has been folded and seamed.

FIG. 3 shows a bib 20 which has been made from the partially completed bib 20*a*, FIG. 2, by U-folding blank 29 along fold lines 40 and 41, and by securing the juxtaposed pairs of seam areas 38 and 39 together as by adhesives or ultrasonic sealing means to form pocket end seams 50, only one of which is shown in the partially torn away area of FIG. 3. Upon being so folded, fold line 40 in fact becomes the bottom edge 28 of pocket 23, FIG. 1; and fold line 41 in fact becomes the upper edge 26 of pocket panel 22. This folding and seaming also folds stays 45 and 46 so as to produce a flat bib (i.e., a bib having an unopened pocket) having low bulk volume which is desirable for packaging and shipping.

Upon applying bib 20, FIG. 3, to a baby as shown in FIG. 1, the pocket 23 is opened so that it will be more apt to catch spilled material than if it remained closed. In such bibs having neither the cuts 27 nor the stays 45 and 46 present, the weight of apron panel 24 tends to gravitationally open pocket 22 due to apron panel 24 being pendulously hung from the upper edge 26 of pocket panel 22. Such gravitational opening of pocket 23 is enhanced in embodiments which have cuts 27 in the top panel 21 adjacent the top corners of pocket 23. Alternatively, in such bibs which comprise stays 45 and 46 or their functional equivalents, the pocket is opened manually and retains its open shape until manually closed. After feeding of the baby has been completed, the apron panel 24 may be torn from the bib by virtue of the line-of-perforations which in blank 29 runs along fold line 41, FIG. 2, and which in the completed bib is in fact disposed along upper edge 26 of pocket 23, FIG. 1.

Referring again to FIG. 1, pendulously hanging apron panel 24 from the upper edge 26 of pocket panel 22 enables a non-detached apron panel 24 to be lifted upward to wipe the baby's face without inverting the pocket. Thus, albeit bibs having full-width pockets and apron panels which depend below the pocket by virtue of being attached to the bottom edge of the pocket are very useful, pendulously attaching the apron panel to the upper edge of the pocket panel provides the additional benefits of gravitationally acting to open the pocket, and obviating pocket inversions as described above.

Figure 4:
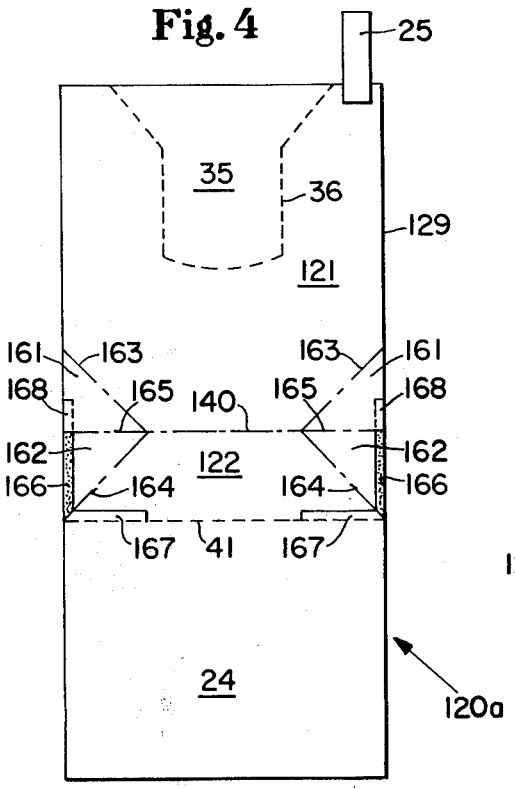
FIG. 4 is a plan view of a partially converted, alternate embodiment blank from which a unitary, pocketed disposable bib having gusseted pocket ends may be made.
Figure 5:
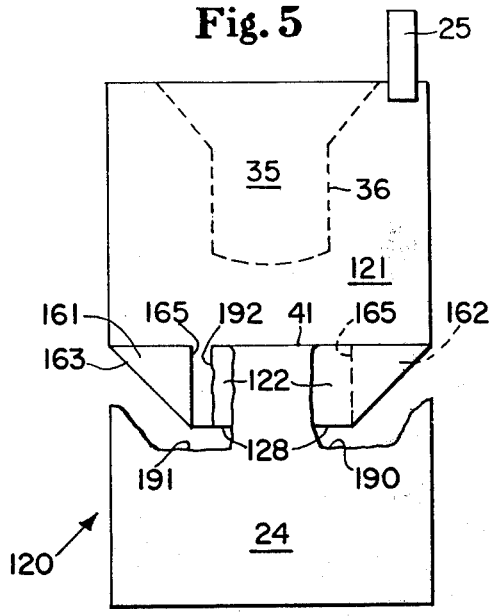
FIG. 5 is a plan view of an alternate embodiment disposable bib made from the partially converted blank of FIG. 4, and which has portions torn away to facilitate describing the bib.
Figure 6:
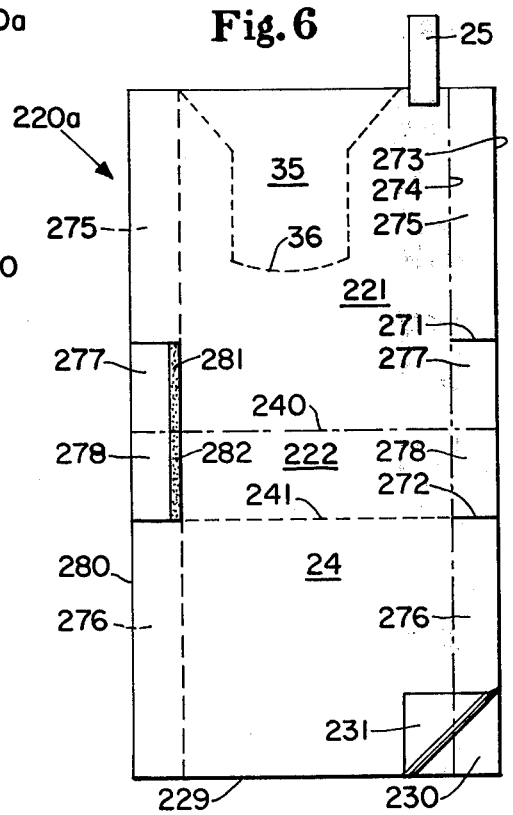
FIG. 6 is a plan view of another partially converted, alternate embodiment blank for making a pocketed disposable bib, and on which blank one longitudinal edge is cut and scored while the other longitudinal edge has been folded and seamed after being similarly cut and scored.
Figure 7:
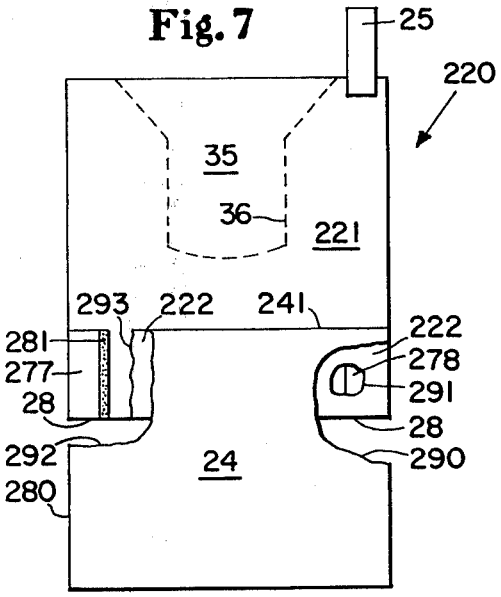
FIG. 7 is a plan view of an alternate embodiment disposable bib made from the partially converted blank of FIG. 6, and which has portions torn away to facilitate describing the bib.

Partially completed alternate bib embodiments are designated 120*a* and 220*a* in FIGS. 4 and 6, respectively; and alternate bibs 120 and 220 are shown in FIGS. 5 and 7, respectively. In these figures, the features and/or elements which are substantially identical to the corresponding features and/or elements of bib 20 are identically designated; and the features and/or elements which are functionally similar to corresponding features and/or elements of bib 20 are identified by three digit designators which have the same tens and units digits as the corresponding features and/or elements of bib 20. Accordingly, the descriptions of bibs 120 and 220 do not contain redundant descriptions of such identical and similar elements and features. Rather, the following descriptions of bibs 120 and 220 are primarily directed to their respective differences with respect to bib 20.

FIG. 4 shows an alternate embodiment, partially completed bib 120*a* which comprises a rectangular-shape unitary blank 129. Blank 120 which has two pairs of triangular-shape gusset panels 161, and 162 defined therein by fold lines 163, 164, and 165, and edge securement areas designated 166, 167 and 168. Upon being folded along fold lines 163–165, each edge securement area 166 becomes juxtaposed an area 167, and the back surface of each area 168 becomes juxtaposed an adjacent portion of the back surface of an area 166. These juxtaposed areas are then adhesively or otherwise secured together to complete alternate embodiment bib 120, FIG. 5.

Bib 120, FIG. 5, has been completed by folding and seaming the partially completed bib 120*a*, FIG. 4, and has had portions thereof torn away to clearly illustrate underlying structural details. More specifically, a portion of apron panel 24 has been torn away along line 190 to reveal the right hand end of pocket panel 122, and the bottom edge 128 of the pocket. Also, a dashed lead line indicates that triangular-shape gusset panel 162 is disposed immediately in back of pocket panel 122; and another dashed lead line identifies the fold line 165 which, upon folding, has become the left vertical edge of gusset panel 162. Another portion of apron panel 24 has been torn away along line 191; and an underlying portion of pocket panel 122 and the left side gusset panel 162 have been torn away along line 192, bottom edge 128, and the left side gusset line 165. This reveals gusset panel 161 as well as a portion of the inside of the pocket of the bib. Provision of the gusseted pocket ends enhances gravitationally opening the pocket as compared to bibs which do not have such gusseted pocket ends: i.e., bibs of the general configuration shown in FIG. 1. Indeed, additional portions of the gussets may be secured to each other to limit the opening of the pocket to a predetermined degree. Also, by making the gusset panels 161 and 162 triangular-shape as shown in FIG. 4, the finished bib 120, FIG. 5, is as wide as blank 29. This conserves bib making material as compared to the bib 220 having pleated pocket endseams as described below.

Partially completed bib 220*a*, FIG. 6, comprises a unitary blank 229 which has transverse cuts 271 and 272 in its right-side longitudinal edge 273, and a longitudinal fold-line 274. The portions designated 275 and 276 are designated edge doubler panels. They are U-folded rearwardly along segments of fold line 274 and secured to the back surface of juxtaposed regions of the backsheet 230 as shown by their respective counterparts disposed along the finished left side edge 280 of blank 229. The portions designated 277 and 278 are designated the pocket pleat panels and are U-folded forwardly into the position shown by their counterparts along the finished left side edge 280 of blank 229. However, the surfaces of pocket pleat panels 277 and 278 which are juxtaposed the front surface of blank 229 are not secured thereto. Rather, pleat securement areas 281 and 282 are defined on the distal edge regions of pocket pleat panels 277 and 278, respectively. Upon U-folding blank 229 along fold-line 240 after both of its longitudinal edges have been prepared as described above, each pleat securement area 281 becomes juxtaposed a pleat securement area 282. They are then secured together by means such as heat sensitive adhesive, or by having first applied two-sided adhesive tape to areas 281 and/or 282 prior to U-folding along fold-line 240, or having deposited contact adhesive on area 281 and/or area 282 prior to such U-folding, or by crimping or ply bonding or the like. Thus, the partially completed bib 220*a*, FIG. 6 is converted into the bib 220, FIG. 7.

Bib 220, FIG. 7, has been completed by folding and seaming the partially completed bib 220*a*, FIG. 6, and has had portions thereof torn away to clearly illustrate underlying structural details. More specifically, a right side portion of apron panel 24 has been torn away along line 290 to reveal pocket panel 222; and a hole having an edge 291 has been torn in pocket panel 222 to reveal a portion of pleat panel 278. Also, a left side portion of apron panel 24 has been torn away along line 292, and an underlying portion of pocket panel 222 has been torn away along lines 293 and 28. Additionally, the left side pleat panel 278, FIG. 6, has been torn away in FIG. 7. These removals reveal the left side pleat panel 277 in its operative position, and the pleat securement area 281 on its distal edge.

Still referring to FIG. 7, cuts corresponding to cuts 27, FIG. 1, may in fact be made in top panel 221 adjacent the top corners of the pocket of bib 220. As stated hereinbefore such cuts may be provided to enhance gravitational opening of the pocket of such a bib. However, full-width pockets having either gusseted or pleated end seams are gravitationally opened by virtue of their respective apron panels pendulously hanging from the upper edges of their respective pocket panels.

In use, bibs 20, 120, and 220 are applied to a wearer such as a baby about to be fed by use of the tape-type fasteners 25, and the pocket is opened: gravitationally if stays 45 and 46 or their equivalents are not included; or manually if they are included. Upon conclusion of the feeding event, the apron portion may be used as a face wipe without being detached from the remainder of the bib; or as a detached wipe if it or a portion thereof is detached from the remainder of the bib along a line-of-weakening: e.g., the line-of-perforations 41, FIG. 2.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A bib comprising a top panel, a substantially full-width pocket panel disposed at the bottom end of said top panel, an apron panel which extends downward below said pocket panel, and means for securing said bib on a user, said pocket panel having a transverse upper edge, and the upper edge of said apron panel being secured to said transverse upper edge so that said apron panel pendulously depends from said transverse upper edge of said pocket, said top panel being cut adjacent each of the top corners of said pocket to promote gravitational opening of said pocket when said bib is applied to a wearer thereof.

2. The bib of claim 1 wherein the ends of said pocket panel are secured to longitudinal edge portions of said top panel with pleated seams.

3. The bib of claim 2 wherein said pleated seams comprise triangular gusset panels.

4. The bib of claim 3 wherein seam securement portions of said panels are secured together to limit the maximum extent of opening said pocket.

5. The bib of claim 1 further comprising bendable, form-sustaining means which are configured and disposed to enable manual opening and closing of said pocket.

6. The bib of claim 5 wherein the ends of said pocket panel are secured to longitudinal edge portions of said top panel with pleated seams, and wherein said bendable, form-sustaining means are integrated into said seams.

7. The bib of claim 1 further comprising means for detaching a portion of said apron panel for use as a post-use wipe.

8. The bib of claim 7 wherein said means for detaching comprises a line-of-weakening which is coextensive with the upper edge of the apron panel.

9. The bib of claim 1, 2, 3, 4, 5, 6, 7 or 8 wherein said panels are portions of a unitary blank.

* * * * *